US008001941B2

(12) United States Patent
Fujii et al.

(10) Patent No.: US 8,001,941 B2
(45) Date of Patent: Aug. 23, 2011

(54) LASH ADJUSTER

(75) Inventors: Hiroki Fujii, Aichi (JP); Katsuhiko Motosugi, Aichi (JP)

(73) Assignee: Otics Corporation, Aichi-Ken (JP)

( * ) Notice: Subject to any disclaimer, the term of this patent is extended or adjusted under 35 U.S.C. 154(b) by 302 days.

(21) Appl. No.: 12/357,477

(22) Filed: Jan. 22, 2009

(65) Prior Publication Data

US 2009/0188457 A1 Jul. 30, 2009

(30) Foreign Application Priority Data

Jan. 30, 2008 (JP) ..... 2008-019066

(51) Int. Cl.
*F01L 1/14* (2006.01)

(52) U.S. Cl. ..... 123/90.52; 123/90.48; 123/90.55

(58) Field of Classification Search ..... 123/90.48, 123/90.52, 90.12, 90.55; 74/567, 569
See application file for complete search history.

(56) References Cited

U.S. PATENT DOCUMENTS

| | | | | |
|---|---|---|---|---|
| 2,688,317 | A | 9/1954 | Voorhies | |
| 2,870,757 | A | 1/1959 | Dayton | |
| 2,942,595 | A | 6/1960 | Bergmann, Sr. et al. | |
| 2,943,611 | A | 7/1960 | Dadd | |
| 2,956,557 | A | 10/1960 | Dadd | |
| 4,881,499 | A | 11/1989 | Dietrich et al. | |
| 5,129,373 | A | 7/1992 | Cuatt et al. | |
| 5,622,147 | A | 4/1997 | Edelmayer | |
| 5,704,319 | A * | 1/1998 | Engelhardt et al. | 123/90.55 |
| 5,855,191 | A | 1/1999 | Blowers et al. | |
| 5,862,785 | A | 1/1999 | Blowers et al. | |
| 5,901,676 | A | 5/1999 | Edelmayer | |
| 6,006,710 | A | 12/1999 | Stephan | |
| 6,039,017 | A | 3/2000 | Hendriksma | |
| 6,598,572 | B2 | 7/2003 | Cecur et al. | |
| 7,644,693 | B2 | 1/2010 | Cecur | |
| 2009/0020088 | A1 | 1/2009 | Fujii et al. | |

FOREIGN PATENT DOCUMENTS

| | | |
|---|---|---|
| DE | 1 273 256 | 7/1968 |
| DE | 38 00945 | 2/1989 |
| DE | 195 29 044 A1 | 2/1997 |

(Continued)

OTHER PUBLICATIONS

Extended European Search Report corresponding to counterpart European Application No. EP 09000524.0, dated Mar. 30, 2009.

*Primary Examiner* — Ching Chang
(74) *Attorney, Agent, or Firm* — Smith, Gambrell & Russell, LLP

(57) ABSTRACT

A lash adjuster for a valve gear includes a plunger movable upward and downward and including a high-pressure chamber, a leak path defined by an inner circumferential surface of a body and an outer circumferential surface of the plunger so that operating oil reserved in the chamber leaks through the leak path, and a ring-shaped member located between the body and the plunger. The member projects into the leak path during normal operation and is elastically deformed radially inward with increase in oil pressure at the chamber side so as to be retreated from the leak path when abnormal movement occurs in the valve gear such that oil pressure in the chamber exceeds a normal range, thereby reducing flow resistance of the oil in the leak path. The member has a surface receiving oil pressure in the chamber thereby to elastically deform the ring-shaped member radially inward.

9 Claims, 4 Drawing Sheets

FOREIGN PATENT DOCUMENTS

| | | | |
|---|---|---|---|
| DE | 199 49497 | A1 | 4/2001 |
| EP | 1 113 147 | A2 | 7/2001 |
| EP | 1 267 045 | A1 | 12/2002 |
| EP | 1 267 046 | A1 | 12/2002 |
| EP | 2 011 974 | A1 | 1/2009 |
| FR | 1 163 535 | A | 9/1958 |
| JP | 2004-278377 | | 10/2004 |

* cited by examiner

LASH ADJUSTER

CROSS-REFERENCE TO RELATED APPLICATIONS

This application is based upon and claims the benefit of priority from the prior Japanese Patent Application No. 2008-19066 filed on Jan. 30, 2008, the entire contents of which are incorporated herein by reference.

BACKGROUND OF THE INVENTION

1. Field of the Invention

The present invention relates to a hydraulic lash adjuster used in valve gears of internal combustion engines.

2. Description of the Related Art

Japanese Patent Application Publication, JP-A-2004-278377, discloses a cylindrical bottomed body and a cylindrical bottomed plunger which is provided in the body so as to be lifted therein. A high-pressure chamber is defined by a lower end of the body and a bottom wall of the plunger. When the plunger is lifted downward, operating oil in the high-pressure chamber is adapted to leak through a gap between an inner periphery of the body and an outer periphery of the plunger.

The plunger has an upper end on which a proximal end of a rocker arm is placed. The proximal end of the rocker arm serves as a rocking fulcrum. The rocker arm has a free end that presses an upper end of a valve stem. The rocker arm is vertically rocked with rotation of a cam slid on an upper surface thereof. A valve is opened by upward movement of the rocker arm, whereas the valve is closed by downward movement of the rocker arm.

When a valve gear causes eccentric movement, the plunger is sometimes moved upward excessively over a normal range of upward and downward movement. Since the rocking fulcrum of the rocker arm is elevated in this case, a cam base is brought into sliding engagement with the rocker arm.

Conventional lash adjusters include a leak path through which operating oil in a high-pressure chamber is caused to leak with downward movement of the plunger. The leak path comprises a narrow gap between an outer periphery of the plunger and an inner periphery of the plunger body. The plunger needs to be quickly moved downward in order that the aforenoted drawback may be avoided. However, resistance of operating oil to flow through the narrow leak path is high. An elastic returning force of a valve spring biasing the valve in a closing direction is increased when the valve is opened, whereupon load the plunger receives from the rocker arm is also increased. Since the resistance of operating oil to flow through the leak path is large as described above, the plunger cannot be quickly moved downward even when having received such a large load as described above.

Increasing a dimensional difference between the outer diameter of the plunger and the inner diameter of the body has simply been considered as means for increasing the descending speed of the plunger, whereupon the sectional area of the leak path can be increased. Consequently, the resistance of operating oil to flow through the leak path can be reduced. However, the leak path also serves as means for attenuating the load the rocker arm applies to the plunger during normal operation of the valve gear and the lash adjuster, thereby suppressing the downward movement of the plunger. Accordingly, the leak path cannot simply be spread.

BRIEF SUMMARY OF THE INVENTION

The present invention provides a lash adjuster which is provided in a valve gear, comprising a cylindrical bottomed body; a cylindrical bottomed plunger which is provided in the body so as to be movable upward and downward and has an underside, the plunger including a high-pressure chamber which is defined between the underside thereof and a bottom wall of the body to reserve an operating oil; a leak path defined by an inner circumferential surface of the body and an outer circumferential surface of the plunger so that the operating oil reserved in the high-pressure chamber leaks therethrough with downward movement of the plunger; and a ring-shaped member provided between the inner circumferential surface of the body and the outer circumferential surface of the plunger, the ring-shaped member projecting into the leak path during a normal operation of the valve gear and being elastically deformed radially inward with increase in pressure of the operating oil at the high-pressure chamber side so as to be retreated from the leak path when an abnormal movement occurs in the valve gear such that the pressure of the operating oil in the high-pressure chamber exceeds a normal range thereof, thereby reducing flow resistance of the operating oil in the leak path, the ring-shaped member having a pressure-receiving surface which receives pressure of the operating oil in the high-pressure chamber thereby to elastically deform the ring-shaped member radially inward, the pressure-receiving surface being inclined relative to the radial direction.

When a downward force applied to the plunger is within a normal range, the ring-shaped member moves into the leak path thereby to narrow the leak path. Accordingly, since the flow resistance of the operating oil in the leak path is relatively larger, the plunger is prevented from being moved downward quickly. On the other hand, when the downward force applied to the plunger is increased, the pressure of the operating oil acting on the ring-shaped member is also increased. Accordingly, the ring-shaped member is elastically deformed radially so as to be retreated from the leak path, whereupon the flow resistance of the operating oil is reduced in the leak path. Consequently, the plunger is quickly moved downward.

DETAILED DESCRIPTION OF THE EMBODIMENTS

Figure 1:
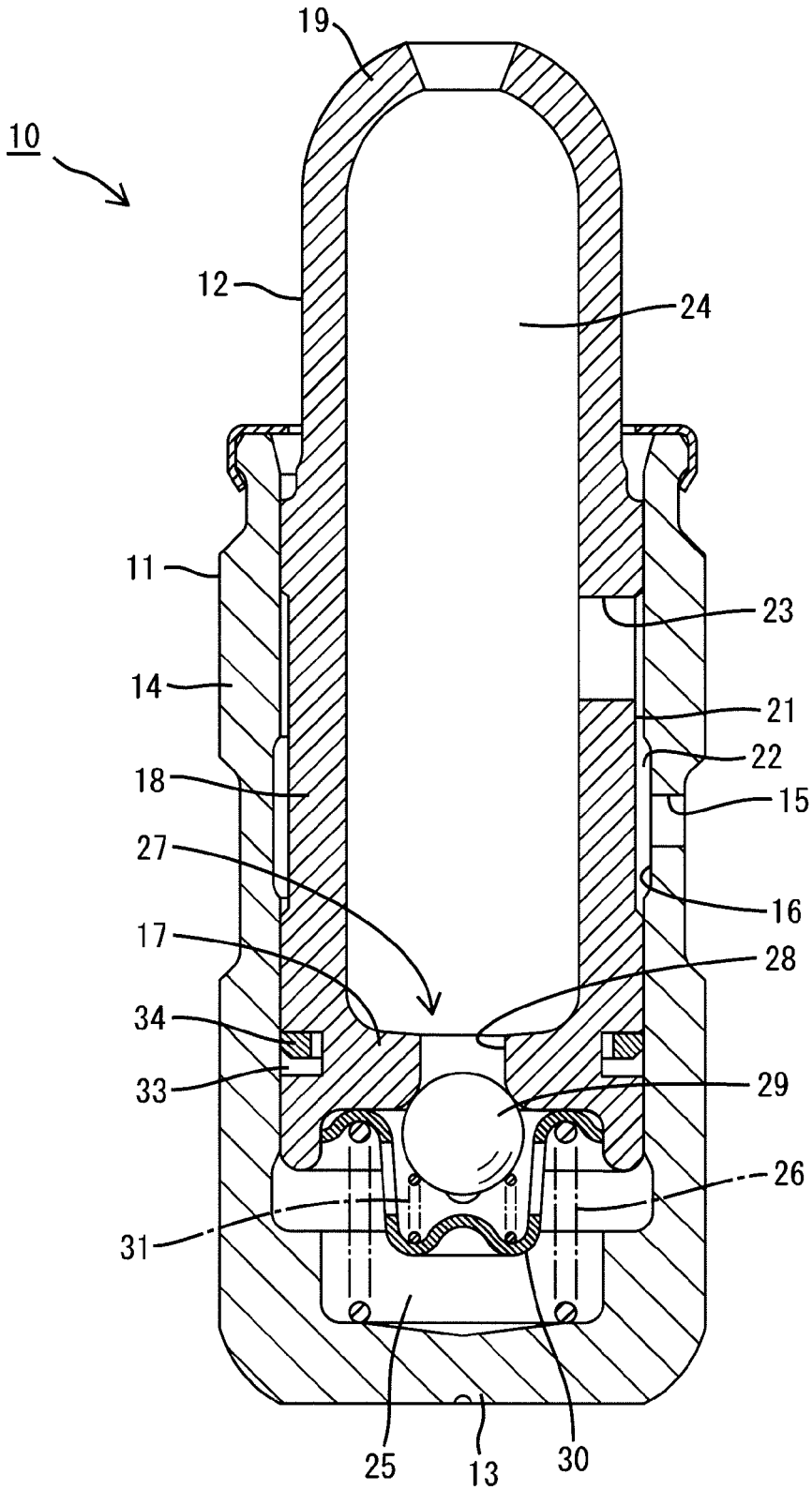
FIG. 1 is a sectional view of a lash adjuster of a first embodiment in accordance with the present invention.

A first embodiment of the present invention will be described with reference to FIGS. 1 to 5. The invention is applied to a hydraulic lash adjuster 10 incorporated in a valve gear of an internal combustion engine in the embodiment. The valve gear comprises the lash adjuster 10, a valve mechanism 42, a rocker arm 50 and a cam 49. A cylinder head 40 of the engine has an upper surface formed with a mounting hole 41.

The lash adjuster 10 is mounted in the mounting hole 41 with a plunger 12 thereof protruding upward.

The valve mechanism 42 comprises a valve stem 44 which is inserted through a guide hole 43 of the cylinder head 40 so as to be vertically movable and a valve 45 formed on a lower end of the valve stem 44. When the valve 45 is moved upward, a suction/exhaust port 46 of the cylinder head 40 is closed such that the valve mechanism 42 assumes a closed state. When the valve 45 is moved downward, the suction/exhaust port 46 is opened such that the valve mechanism 42 assumes an open state. A valve spring 48 comprising a compression coil spring is provided between the upper surface of the cylinder head 40 and a backing plate 47 secured to an upper end of the valve stem 44. The valve spring 48 biases the valve in a valve-closing direction. An elastic returning force (a biasing force) of the valve spring 48 is increased as the valve 45 is moved in a valve-opening direction or downward.

An oval cam 49 is rotatably mounted above the lash adjuster 10 and the valve mechanism 42. The rocker arm 50 is provided between the cam 49, and the lash adjuster 10 and valve stem 44. The rocker arm 50 has one end formed with a fulcrum 51 which is placed on a bearing portion 19 formed on an upper end of the plunger 12 of the lash adjuster 10 and the other rocking end 52 which is placed on an upper end of the valve stem 44. The rocker arm 50 has an upper surface on which a peripheral surface of the cam 49 is slid between the fulcrum 51 and the rocking end 52.

Figure 4:
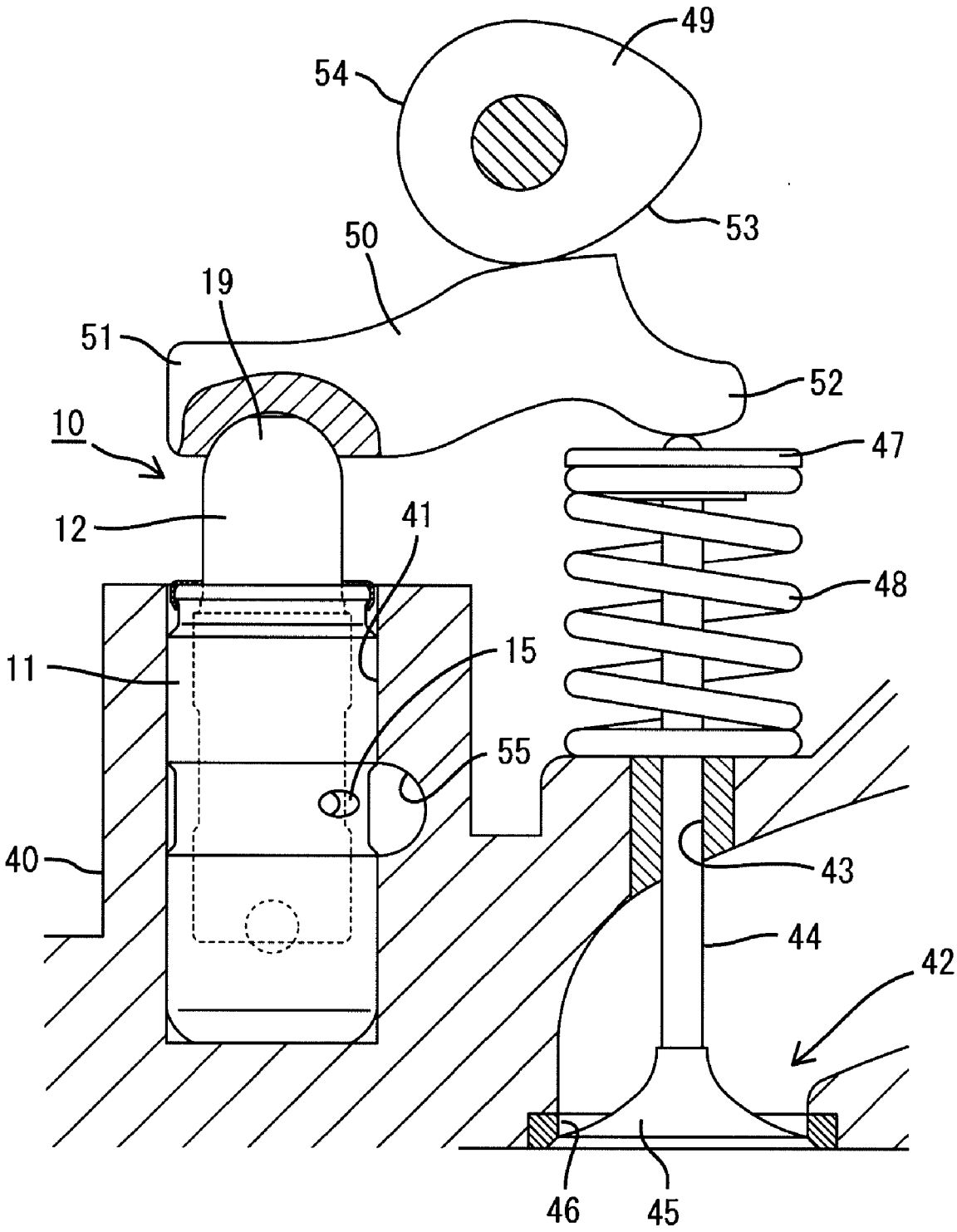
FIG. 4 is a sectional view of a valve gear incorporating the lash adjuster.
Figure 5:
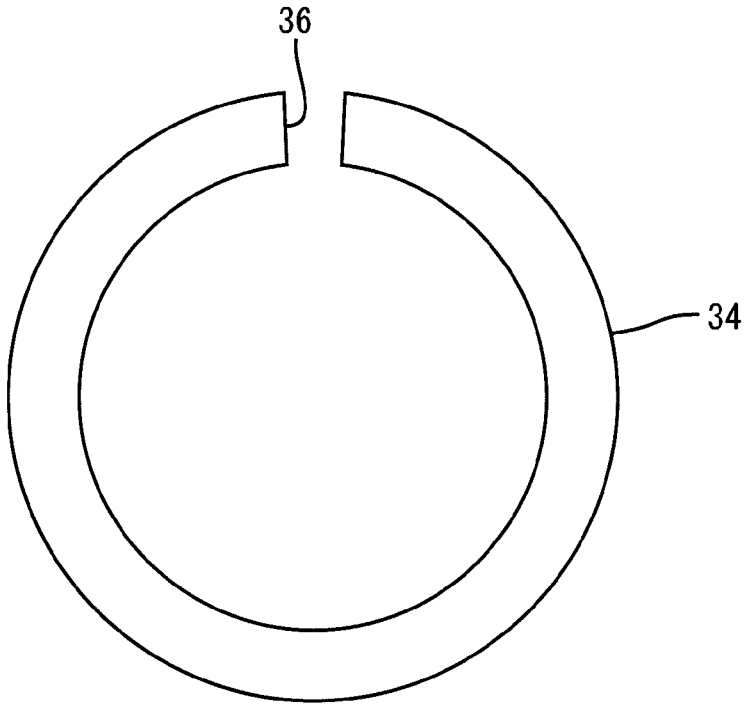
FIG. 5 is a plan view of the ring-shaped member of the lash adjuster.

Upon rotation of the cam 49, the rocker arm 50 is rocked so that the rocking end 52 is vertically displaced about the fulcrum 51. When an arc cam base 53 of the cam 49 is in sliding contact with the upper surface of the rocker arm 50, the valve spring 48 biases the rocker arm 50 to an upper position, whereby the valve mechanism 42 is closed as shown in FIG. 4. On the other hand, when a cam nose 54 is in sliding contact with the upper surface of the rocker arm 50, the cam 49 displaces the rocker arm 50 downward against the biasing force of the valve spring 48. Accordingly, the valve 45 is moved downward such that the valve mechanism 42 is opened.

An urging force of the valve spring 48 acts via the valve 45 and the rocker arm 50 upon an upper end of the plunger 12 as a downward pressing force when the valve mechanism 42 is opened or closed. Accordingly, the downward pressing force acting on the plunger 12 is increased more as the opening of the valve mechanism 42 is increased.

The lash adjuster 10 will now be described. The lash adjuster 10 comprises a body 11 and the plunger 12. The body 11 is formed into a bottomed cylindrical shape and includes a circular bottom 13 and a circumferential wall 14 rising from a circumferential edge of the bottom 13. The circumferential wall 14 has an external communication hole 15 which is formed near an upper end thereof so as to extend through inner and outer circumferential surfaces. The external communication hole 15 communicates with an operating oil supply path provided in the cylinder head 40. A circumferential diameter-increased portion 16 is formed on an entire inner circumference of the body 11 so as to be concentric with the body 11 and so as to be opposed to the external communication hole 15.

The plunger 12 is formed into a bottomed cylindrical shape and includes a circular bottom 17 and a circumferential wall 18 rising from a circumferential edge of the bottom 17. The plunger 12 is fitted into the body 11 from an upper open end of the body and is movable upward and downward relative to the body 11. The plunger 12 has an upper end protruding out of the upper open end of the body 11. The upper end of the plunger 12 is formed with a substantially semispherical or dome-shaped bearing portion 19 having an outer surface against which the fulcrum 51 of the rocker arm 50 is abutted thereby to be supported on the bearing portion 19.

A circumferential diameter-decreased portion 21 is formed on an entire outer circumference of the circumferential wall 18 of the plunger 12 so as to be concentric with the body 11. At least a part of the diameter-decreased portion 21 is opposed to the diameter-increased portion 16. A circumferential communication path 22 is defined between the diameter-increased and diameter-decreased portions 21 and 16. The communication path 22 extends along whole circumferences of the diameter-increased and diameter-decreased portions 21 and 16. The circumferential wall 18 of the plunger 12 has an inner communication path 23 which is formed so as to extend through an upper end of the diameter-decreased portion 21. The inner communication path 23 communicates via the communication path 22 with the external communication path 15.

A hollow interior of the plunger 12 serves as a low-pressure chamber 24. An operating oil is supplied from an operating oil supply path 55 in the cylinder head 40 through the communication paths 15, 22 and 23 sequentially into the low-pressure chamber 24. Furthermore, a high-pressure chamber 25 is formed in the lower interior of the body 11. The high-pressure chamber 25 is partitioned from the low-pressure chamber 24 by the bottom wall 17 of the plunger 12. The high-pressure chamber 25 is filled with the operating oil supplied from the low-pressure chamber 24 through a check valve 27 which will be described later. An urging spring 26 is provided in the high-pressure chamber 25 for upwardly urging the plunger 12.

The check valve 27 is disposed at a lower end of the lash adjuster 10. The check valve 27 comprises a valve port 28 extending vertically through the bottom wall 17 of the plunger 12, a spherical valve element 29 disposed in the high-pressure chamber 25 for opening and closing the valve port 28 and a valve spring 31 disposed in a retainer 30 for urging the valve element 29 to the valve port 28 side. The check valve 27 is normally retained in a closed state where the valve element 29 is urged by the urging spring 26 thereby to close the valve port 28. When the plunger 12 is moved upward, the valve element 29 is departed from the valve port 28 such that the check valve 27 is opened, whereupon the operating oil in the low-pressure chamber 24 is allowed to flow through the valve port 28 into the high-pressure chamber 25. Furthermore, when the plunger 12 is moved downward, the valve element 29 is pressed against the valve port 28 such that the check valve 27 is closed, which limits the flow of the operating oil from the high-pressure chamber 25 into the low-pressure chamber 24.

Figure 2:
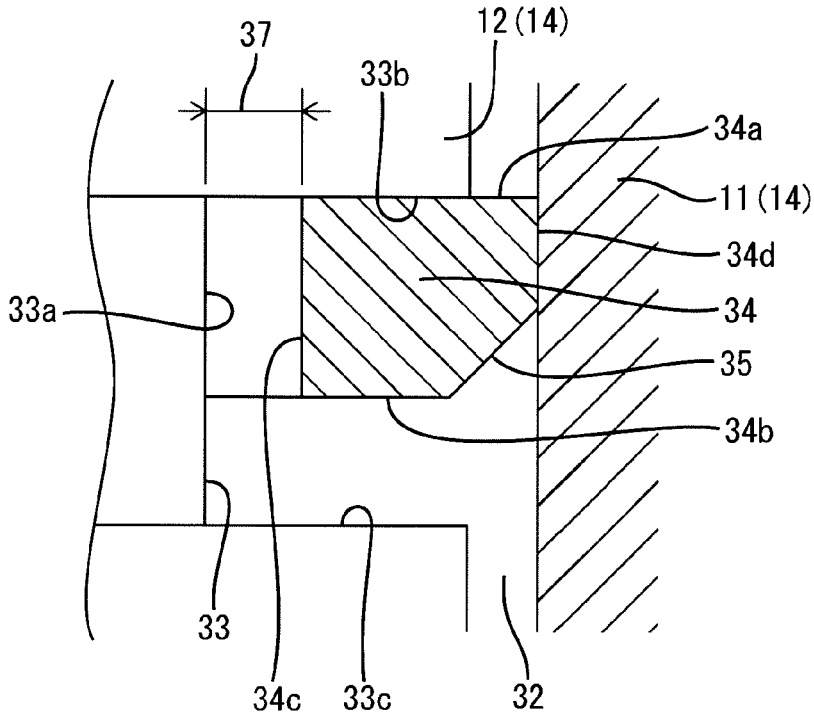
FIG. 2 is a partially enlarged sectional view of the lash adjuster as shown in FIG. 1 when a ring-shaped member is not elastically deformed.
Figure 3:
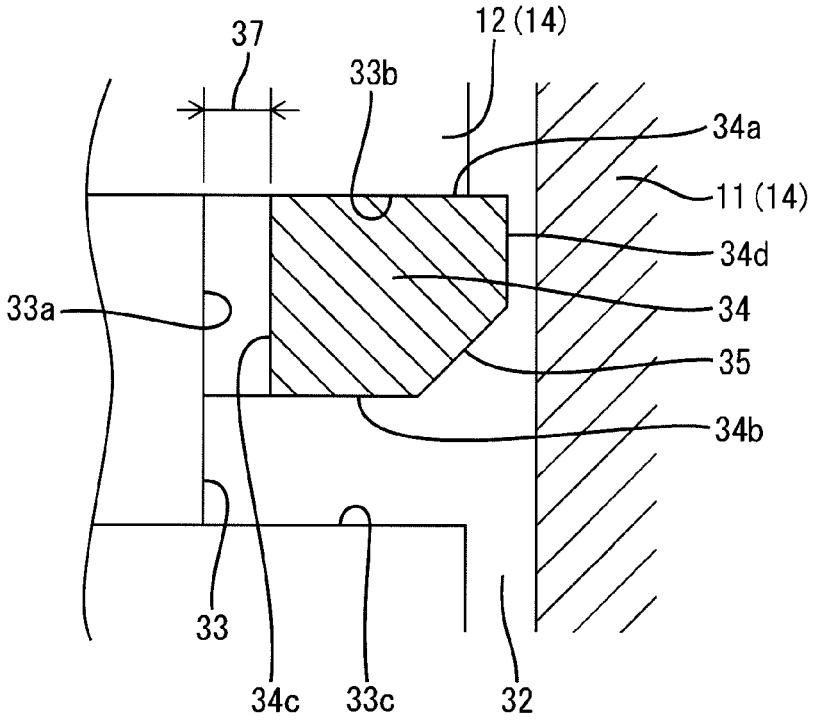
FIG. 3 is a partially enlarged sectional view of the lash adjuster when the ring-shaped member has elastically been deformed.

The space between the inner circumference of the body 11 and the outer circumference of the plunger 12 includes an area from the high-pressure chamber 25 to the communication path 22. The area serves as a leak path through which the operating oil is caused to leak to the communication path 22, as shown in FIGS. 2 and 3. The outer circumferential surface of the plunger 12 includes an area that is opposed to the leak path 32 and has a circumferential retaining groove 33 formed continuously over the whole circumference. The retaining groove 33 has a square section. The retaining groove 33 has a bottom parallel with the outer circumferential surface of the plunger 12 and an upper surface 33*b* and an underside 33*c* both of which are at a right angle to the outer circumferential surface of the plunger 12.

A ring-shaped member 34 is attached to the retaining groove 33. The ring-shaped member 34 is made of an elastic material with resistance to oil, for example, a metal or synthetic resin. The ring-shaped member 34 is generally annular in shape and more specifically is generally formed into a C-shape. Accordingly, the ring-shaped member 34 is not continuous over the whole circumference. The ring-shaped member 34 has a pentagon-shaped section, and more specifically, one corner of a square is cut out into a tapered shape. The upper surface 34*a* and the underside 34*b* are parallel to each other, and the inner and outer circumferential surfaces 34*c* and 34*d* are parallel to each other. The tapered cutout surface located between the outer circumferential surface 34*d* and the underside 34*b* serves as a pressure-receiving surface 35 inclined relative to them.

The ring-shaped member 34 is accommodated in the retaining groove 33 in an elastically diameter-decreased state. The outer circumferential surface 34*d* of the ring-shaped member 34 is normally adhered closely to the inner circumferential surface of the body 11 by an elastic returning force of the ring-shaped member 34. In this state, a cutout space defined between both circumferential ends of ring-shaped member 34 serves as a communication portion 36 which allows the ring-shaped member 34 to deform into the diameter-decreased shape and the operating oil to flow. Furthermore, between the inner circumferential surface 34*c* and the bottom 33*a* of the retaining groove 33 is ensured a clearance 37 which allows the ring-shaped member 34 to deform into the diameter-decreased shape, that is, to elastically deform radially. The clearance 37 is adapted to be ensured even when both ends of the ring-shaped member 34 abut against each other such that no communication portion 36 is defined, that is, even when an amount of diameter-decreased deformation becomes maximum.

Furthermore, the operating oil filling a part of the leak path 32 located below the ring-shaped member 34 (the high-pressure chamber 25 side) is in contact with the pressure-receiving surface 35 of the ring-shaped member 34 and the underside 34*b*. Accordingly, the ring-shaped member 34 is pressed upward by the pressure of the operating oil in the high-pressure chamber 25. As a result, an area of the upper surface 34*a* located at the inner circumferential side is in abutment with the upper surface 33*b* of the retaining groove 33 in a face-to-face contact. On the other hand, a space is defined between the underside 34*b* of the ring-shaped member 34 and the underside 33*c* of the retaining groove 33. Furthermore, when the ring-shaped member 34 is radially deformed, the upper surface 34*a* of the ring-shaped member 34 is brought into sliding contact with the upper surface 33*b* of the retaining groove 33.

The operation of the lash adjuster will now be described. When spaces are defined between the valve stem 44 and the rocker arm 50 and between the cam 49 and the rocker arm 50 during normal operation of the valve gear, the plunger 12 is moved upward by the urging force of the urging spring 26 thereby to infill the space. In this case, since the pressure is reduced in the high-pressure chamber 25, the check valve 27 is opened such that the operating oil flows from the low-pressure chamber 24 into the high-pressure chamber 25. Consequently, the operating oil in the high-pressure chamber 25 is prevented from leaking through the leak path 32.

Furthermore, when a pressing force that the cam 49 applies to the rocker arm 50 is increased during normal operation of the valve gear, the load the rocker arm 50 applies to plunger 12 is increased. As a result, the plunger 12 is moved downward. In this case, since the pressure is increased in the high-pressure chamber 25, the check valve 27 is retained in the closed state, whereupon the operating oil in the high-pressure chamber 25 leaks through the leak path 32. The load applied to the plunger in this case is within a normal range. Accordingly, the ring-shaped member 34 is retained in the leak path 32 with almost no elastic deformation, that is, the outer circumferential surface of the ring-shaped member 34 closely adheres to the inner circumferential surface of the body 11. As a result, since the operating oil leaks through the communication portion 36, the flow resistance in the flow through the communication portion 36 results in a damping force against the downward movement of the plunger 12. Since the load applied to the plunger 12 is damped, the plunger 12 is moved downward at a relatively lower speed.

On the contrary to the above normal operation, when an abnormal movement occurs in the valve gear, the plunger 12 is sometimes moved downward over a normal range of upward movement. In this case, since the location of the fulcrum 51 of the rocker arm 50 is rendered higher, the cam base 54 of the cam 49 is brought into sliding contact with the rocker arm 50. As a result even when the rocking end 52 of the rocker arm 50 reaches an uppermost location, there is a possibility that the valve mechanism 42 is not completely closed. In this case, when the valve mechanism 42 is opened most largely in the state where the plunger 12 has been moved excessively upward over the normal range of upward movement or when the valve 45 is located at the lowermost location, the urging force stored in the valve spring 48 (elastic returning force) is increased over the normal range. As a result, the downward pressing force the rocker arm 50 applies to the plunger 12 is also increased over a normal range thereof. The pressure of the operating oil in the high-pressure chamber 25 is also increased over a normal range thereof. The ring-shaped member 34 is elastically deformed by the large pressure so that the diameter thereof is decreased. This radial deformation of the ring-shaped member 34 increases the space between the outer circumferential surface of the ring-shaped member 34 and the inner circumferential surface of the body 11. The leak path almost closed by the ring-shaped member 34 is opened such that a flow range of the operating oil in the leak path 32 is increased. The operating oil leaks at a larger flow rate than in the normal flow. More specifically, the flow resistance of the operating oil leaking from the high-pressure chamber 25 is reduced. Since the flow resistance acts as resistance in the downward movement of the plunger 12, the plunger 12 is moved downward at a higher speed than in the normal case, whereupon the height of the plunger 12 returns to the normal range.

The ring-shaped member 34 is formed with the pressure-receiving surface 35 which is inclined in the radial direction or the direction in which the ring-shaped member 34 is deformed. Since the pressure-receiving surface 35 is capable of receiving the pressure of the operating oil from the high-pressure chamber 25 side, the pressure the operating oil applies to the pressure-receiving surface 35 imparts a radial pressing force to the ring-shaped member 34. Accordingly, the ring-shaped member 34 can reliably be deformed radially.

Furthermore, the ring-shaped member 34 is accommodated in the retaining groove 33 formed in the outer circumferential surface of the plunger 12. The radial clearance 37 is ensured between the bottom 33*a* of the retaining groove 33 and the inner circumferential surface 34*c* of the ring-shaped member 34 when an amount of radial deformation of the ring-shaped member 34 becomes maximum, as shown in FIG. 3. Accordingly, when the plunger 12 is displaced so as to be radially decentered relative to the body 12, the displacement is absorbed by the radial clearance 37 ensured between the bottom 33*a* and the inner circumferential surface 34*c*.

Additionally, the ring-shaped member 34 is formed with the communication portion 36 allowing the operating oil to flow therethrough. Accordingly, when the opening of the communication portion 36 is set to a suitable area, the flow resistance of the operating oil during leakage can be set to any value under the condition where the downward force applied to the plunger 12 is within a normal range.

Figure 6:
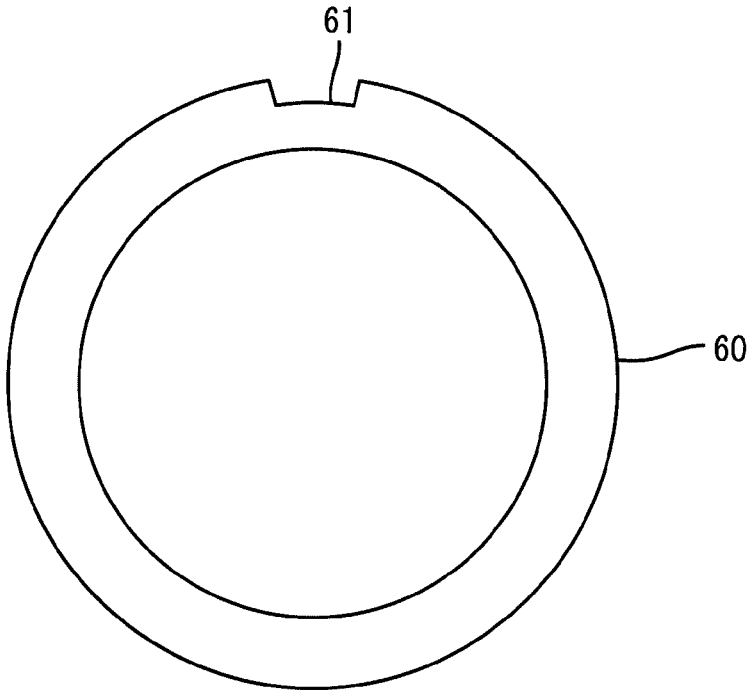
FIG. 6 is a plan view of the lash adjuster of a second embodiment in accordance with the invention.

FIG. 6 illustrates a second embodiment of the invention. The second embodiment differs from the previous embodiment in the construction of the ring-shaped member 60. Since the second embodiment is the same as the previous embodiment in the other respects, the identical or similar parts in the second embodiment are designated by the same reference symbols as those in the previous embodiment, and the description of these parts will be eliminated.

The ring-shaped member 60 is formed into an annular shape so as to be circumferentially continuous. A part of the outer circumference of the ring-shaped member 60 is notched into a recessed shape without extending radially through the ring-shaped member, as shown in FIG. 6. Furthermore, the ring-shaped member 60 is made of a synthetic resin. When the pressure from the high-pressure chamber 32 side is increased over the normal range, the ring-shaped member 60 is elastically deformable radially so as to reduce the radius thereof while a circumferential surface thereof is distorted.

In the foregoing embodiments, the ring-shaped member is elastically deformed so as to reduce the radius thereof when retreated from the leak path. However, the ring-shaped member may be elastically deformed so as to increase the radius thereof, instead. In this case, the retaining groove retaining the ring-shaped member is formed in the inner circumferential surface of the body.

The pressure-receiving surface is formed so as to extend over the whole circumference of the ring-shaped member in the foregoing embodiments. However, the pressure-receiving surface may be formed in a part of the circumference of the ring-shaped member, instead. Furthermore, the radial clearance is ensured between the bottom of the retaining groove and the inner circumferential surface of the ring-shaped member when the ring-shaped member has reached the maximum amount of radial deformation. However, no radial clearance may be provided between the bottom of the retaining groove and the inner circumferential surface of the ring-shaped member when ring-shaped member has reached the maximum amount of radial deformation, instead.

The ring-shaped member has one communication portion in the foregoing embodiments. However, a plurality of communication portions may be formed in the ring-shaped member, instead. Furthermore, although the ring-shaped member is formed with the communication portion in the foregoing embodiments, no ring-shaped member may be formed in the ring-shaped member, instead.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A lash adjuster which is provided in a valve gear, comprising:

a cylindrical bottomed body;

a cylindrical bottomed plunger which is provided in the body so as to be movable upward and downward and has an underside, the plunger including a high-pressure chamber which is defined between the underside thereof and a bottom wall of the body to reserve an operating oil;

a leak path defined by an inner circumferential surface of the body and an outer circumferential surface of the plunger so that the operating oil reserved in the high-pressure chamber leaks therethrough with downward movement of the plunger; and a ring-shaped member provided between the inner circumferential surface of the body and the outer circumferential surface of the plunger, the ring-shaped member projecting into the leak path during a normal operation of the valve gear and being elastically deformed radially inward with increase in pressure of the operating oil at the high-pressure chamber side so as to be retreated from the leak path when an abnormal movement occurs in the valve gear such that the pressure of the operating oil in the high-pressure chamber exceeds a normal range thereof, thereby reducing flow resistance of the operating oil in the leak path, the ring-shaped member having a pressure-receiving surface which receives pressure of the operating oil in the high-pressure chamber thereby to elastically deform the ring-shaped member radially inward, the pressure-receiving surface being inclined relative to the radial direction.

2. The lash adjuster according to claim 1, wherein the ring-shaped member is formed into a C-shape with a circumferential cut part.

3. The lash adjuster according to claim 2, wherein the outer circumferential surface of the plunger has a retaining groove which is formed therein so as to be open toward the leak path, and the ring-shaped member is accommodated in the retaining groove.

4. The lash adjuster according to claim 3, wherein the ring-shaped member has a communicating portion which allows the operating oil to axially pass therethrough, and the ring-shaped member has a portion that is other than the communicating portion and closely adheres to the inner circumferential surface of the body and a wall surface of the retaining groove, thereby providing a seal.

5. The lash adjuster according to claim 3, wherein, when an amount of radial deformation of the ring-shaped member is maximum, a radial clearance is ensured between a bottom of the retaining groove and a circumferential edge of the ring-shaped member.

6. The lash adjuster according to claim 1, wherein the ring-shaped member is formed into an annular shape with an entire continuous circumference and is elastically deformable in a diameter-reducing direction upon subjection to the pressure of the operating oil while a circumferential face thereof is distorted.

7. The lash adjuster according to claim 1, wherein the outer circumferential surface of the plunger has a retaining groove which is formed therein so as to be open toward the leak path, and the ring-shaped member is accommodated in the retaining groove.

8. The lash adjuster according to claim 7, wherein the ring-shaped member has a communicating portion which allows the operating oil to axially pass therethrough, and the ring-shaped member has a portion that is other than the communicating portion and closely adheres to the inner circumferential surface of the body and a wall surface of the retaining groove, thereby providing a seal.

9. The lash adjuster according to claim 7, wherein when an amount of radial deformation of the ring-shaped member is maximum, a radial clearance is ensured between a bottom of the retaining groove and a circumferential edge of the ring-shaped member.

* * * * *